US009770755B2

(12) United States Patent
Boisdequin et al.

(10) Patent No.: US 9,770,755 B2
(45) Date of Patent: Sep. 26, 2017

(54) CASTING PLATE AND CASTING PLATE CASING WITH DETECTOR-ENGAGING PROTRUSION

(71) Applicant: VESUVIUS GROUP S.A., Ghlin (BE)

(72) Inventors: Vincent Boisdequin, Naast (BE); Mariano Collura, Bracquegnies (BE)

(73) Assignee: VESUVIUS GROUP S.A., Ghlin (BE)

( * ) Notice: Subject to any disclaimer, the term of this patent is extended or adjusted under 35 U.S.C. 154(b) by 40 days.

(21) Appl. No.: 14/067,017

(22) Filed: Oct. 30, 2013

(65) Prior Publication Data

US 2014/0048225 A1 Feb. 20, 2014

Related U.S. Application Data

(62) Division of application No. 13/635,976, filed as application No. PCT/EP2011/001323 on Mar. 17, 2011, now Pat. No. 8,602,085.

(30) Foreign Application Priority Data

Mar. 19, 2010 (EP) ..... 10157128
Mar. 19, 2010 (EP) ..... 10157129

(51) Int. Cl.

| | |
|---|---|
| ***B22D 11/00*** | (2006.01) |
| ***B22D 41/24*** | (2006.01) |
| ***B22D 41/34*** | (2006.01) |
| ***B22D 41/38*** | (2006.01) |
| ***B22D 41/56*** | (2006.01) |

(52) U.S. Cl.

CPC ..... *B22D 11/00* (2013.01); *B22D 41/24* (2013.01); *B22D 41/34* (2013.01); *B22D 41/38* (2013.01); *B22D 41/56* (2013.01)

(58) Field of Classification Search

CPC ..... B22D 41/24; B22D 41/34; B22D 41/56; B22D 41/38; B22D 41/28

USPC ..... 222/600, 606–607

See application file for complete search history.

(56) References Cited

U.S. PATENT DOCUMENTS

| | | | | |
|---|---|---|---|---|
| RE27,237 E | | 11/1971 | Shapland | |
| 4,802,611 A | * | 2/1989 | Schuhmacher | B22D 41/26 222/502 |
| 5,011,050 A | * | 4/1991 | Verel | 222/600 |
| 5,074,442 A | * | 12/1991 | Fricker | 222/600 |
| 5,141,139 A | * | 8/1992 | Kleeblatt | B22D 41/38 222/600 |

(Continued)

FOREIGN PATENT DOCUMENTS

| | | |
|---|---|---|
| EP | 0192019 A1 | 8/1986 |
| EP | 1439016 A1 | 7/2004 |

(Continued)

*Primary Examiner* — Kevin E Yoon
*Assistant Examiner* — Jacky Yuen
(74) *Attorney, Agent, or Firm* — Thomas Clinton; Donald M. Satina

(57) ABSTRACT

Casting plates constructed for facing the casting orifice of a metallurgical vessel are provided with a metallic casing. The casting plates and metallic casing are provided with a protrusion configured to interact with a detector. The casing has a main surface with an opening, and two substantially longitudinal bearing surfaces. The protrusion extends from the casing in a direction substantially parallel to the longitudinal bearing surfaces. The protrusion is formed by a ramp having an inclined portion.

9 Claims, 13 Drawing Sheets

(56) References Cited

U.S. PATENT DOCUMENTS

| | | | | | |
|---|---|---|---|---|---|
| 5,173,199 | A | | 12/1992 | Bruckner et al. | |
| 5,174,908 | A | | 12/1992 | King et al. | |
| 5,211,857 | A | * | 5/1993 | Brinker | 222/600 |
| 5,351,865 | A | | 10/1994 | Szadkowski et al. | |
| 5,470,048 | A | * | 11/1995 | Taira et al. | 266/236 |
| 5,688,425 | A | * | 11/1997 | Yamamoto et al. | 222/606 |
| 5,879,579 | A | | 3/1999 | Yoshino et al. | |
| 2004/0104521 | A1 | * | 6/2004 | Yokoi et al. | 266/266 |

FOREIGN PATENT DOCUMENTS

| | | | |
|---|---|---|---|
| JP | 6292955 | A | 10/1994 |
| WO | 2004/065041 | A1 | 8/2004 |

* cited by examiner

CASTING PLATE AND CASTING PLATE CASING WITH DETECTOR-ENGAGING PROTRUSION

BACKGROUND OF THE INVENTION (a) Field of the Invention

The present invention relates to the art of continuous molten metal casting.

More specifically, the invention relates to a casting plate and a casting plate casing with a detector-engaging protrusion. The casting plate may be used with a metallurgical vessel of a casting installation. This plate may be a calibrated plate or a casting tube. These types of plates are usually part of a nozzle comprising a plate connected to a tubular section of varying lengths depending on the applications.

(b) Description of Related Art

A device for replacing casting tubes, arranged facing a casting orifice of a metallurgical vessel of a continuous molten metal casting installation is known, particularly from the document EP 0 192 019 A1. Such a device comprises guiding means generally two rails whereon casting tubes can slide, to occupy firstly a standby position, followed by an operating position and finally an evacuation or exit position opposite the standby position. A drive also called actuator or pusher, actuated by a jack or cylinder, is used to push a casting tube from the standby station thereof to the operating station thereof, the tube moved expelling for this reason, to the evacuation station, the worn casting tube situated on the operating station.

The casting tube comprises a sliding face wherein a casting channel opens, which is in registry with the metallurgical vessel orifice when the casting tube is at the operating station. The metallurgical vessel orifice generally consists of the casting orifice of the upstream refractory element or the casting orifice of the upstream refractory elements which are in fluid communication. The upstream refractory element is generally rigidly connected to the metallurgical vessel, for example, it is cemented or mortared therein.

In the operating position, pushers also called thrusters are arranged extending from the guiding means or rails. These pushers are used to apply a substantially vertical force on two bottom faces of the plate of the casting tube such that the tube sliding face is in tight contact with the face of the upstream refractory element.

In some cases, as in WO 2004/065041A1 (particularly paragraph 23), the casting tube sliding face is sufficiently large to form, next to the casting orifice, a sealing surface suitable for sealing or closing the metallurgical vessel casting orifice if the casting tube is moved over a distance at least equal to the diameter of the metallurgical vessel orifice. The sealing surface is also called shut-off surface or closure surface.

The casting tube present on the operating station can thus adopt two positions:

- a casting position, wherein the casting channel thereof is facing the metallurgical vessel casting orifice, and
- a sealing position, wherein the sealing surface thereof is facing the metallurgical vessel casting orifice.

In this case, the casting tube may be used not only for casting the molten metal, but also for stopping (interrupting) the casting in the event of an emergency, which is useful for example if another upstream shutdown device is defective.

The movement of the casting tube on the guiding means, for instance the rails, thus needs to be controlled selectively, according to whether it is to be moved to the casting position or the sealing position on the operating station, requiring the use of one or more double-stroke jacks. However, such jacks are bulky, heavy and costly. Furthermore, they require the presence of at least two separate hydraulic supplies on the continuous casting floor.

The present invention is intended to provide a technical solution for controlling the movement of the casting tube, and more generally of a casting plate, to the casting position or to the sealing position on the operating station, completely automatically, simply and reliably.

For this purpose, the present invention relates to a device for holding and replacing a casting plate facing a casting orifice of a metallurgical vessel of a continuous molten metal casting installation, the casting plate being of the type comprising a sliding face wherein a casting channel opens and wherein a sealing surface suitable for sealing the metallurgical vessel casting orifice is formed, said device being of the type comprising a pusher or drive suitable for pushing a casting plate to move it from a standby station to an operating station, a plate on the operating station being suitable for adopting a casting position, wherein the casting channel thereof is facing the metallurgical vessel casting orifice, and a sealing position, wherein the sealing surface is facing the metallurgical vessel casting orifice, the pusher being provided with means for selectively moving same along two strokes:

- a short stroke pushing a casting plate to the casting position on the operating station, or
- a long stroke pushing a casting plate to the sealing position on the operating station, said device being characterised in that it comprises:

- a casting plate passage detector between the standby station and the operating station,
- a pusher limit switch, controlled by the passage detector and suitable for adopting:
- a replacement position corresponding to a casting position, adopted when the detector detects the passage of a casting plate, wherein the limit switch limits the pusher stroke to the short stroke, and
- a sealing position, in the other cases, wherein the limit switch allows the pusher to move over the long stroke.

By means of the plate passage detector, if the pusher is actuated and a replacement plate is situated on the standby station, the detector controls the limit switch which is set to the replacement position and limits the stroke of the pusher such that the casting plate is moved to the casting position on the operating station, whereas, if no plate is situated on the standby station, the limit switch allows the pusher to cover the long stroke thereof to push the plate present on the operating station to the sealing position.

The operator thus no longer needs to determine whether it is necessary to actuate the pusher for a plate replacement or an emergency stop. The passage detector and the limit switch determine which stroke of the pusher is required automatically.

In particular, if the operator actuates the jack without having positioned a replacement plate on the standby station, an emergency stop is required. The device according to the invention thus automatically actuates the jack over the long stroke thereof so that it moves the plate to the sealing position.

Therefore, the invention provides, besides a simple and economical jack control device, improved safety on the casting site, both for the operator himself, who no longer needs to intervene in the vicinity of the molten metal, and for the entire site, in that the operator can respond more rapidly in the event of an emergency and does not risk to make a mistake.

The majority of known devices do not comprise double-stroke jacks, or casting tubes having a sealing surface. When an emergency stop is required, the operator needs to intervene in the vicinity of the molten metal, remove the tube in standby position, replace it by a blank plate and then actuate the jack to move the blank plate into the casting position. The devices equipped with a double-stroke jack and a casting plate comprising a sealing surface are already an improvement as the blank plate and its handling is not necessary anymore. However, they present the drawbacks mentioned above. Double-stroke jacks are bulky, heavy, costly and require the presence of at least two separate hydraulic supplies. These and other problems and disadvantages associated with the prior art are overcome by the invention disclosed herein by providing a simple, economical and safe method for actuating a device. The operator can actuate the jack remotely and very rapidly and seal the casting channel.

In one advantageous embodiment, the limit switch is arranged so as to retain the replacement position after detecting the passage of a casting plate, as long as the pusher has not moved back after covering the entire short stroke thereof.

For this purpose, a stabilizer is incorporated in the limit switch, so that said limit switch retains the position set by the passage detector, even after the passage detector has stopped detecting the presence of a plate.

In one particular embodiment of the invention, the passage detector is a lever which is actuated by the casting plate when it moves from the standby station to the operating station.

This means offers the advantage of being simple to produce and reliable in the operation thereof.

Advantageously, the limit switch comprises a movable abutment, the pusher or drive comprising a bearing surface suitable for resting on the abutment only when the limit switch is in the sealing position.

The lever and the movable abutment may be connected by a ball type connection, which converts the rotation of the lever into a translation movement of the movable abutment. Any other link suitable for transmitting the movement of the lever to the movable abutment could obviously be suitable.

In one particular embodiment of the invention, the pusher comprises a rod and the pusher bearing surface is formed by a recess provided in the rod.

This embodiment is advantageous in that it is simple to produce and reliable in the operation thereof.

In certain embodiments, the recess provided in the rod comprises, opposite the bearing surface, a bevel replacing the movable abutment in the replacement position when the rod moves back after the pusher has covered the entire short stroke thereof.

According to one advantageous embodiment, the device comprises an evacuation or exit station, whereto a worn plate is sent when pushed by a plate pushed to the operating position by the pusher.

The invention also relates to an assembly of a casting plate and a device for holding and replacing casting plates wherein the casting plate comprises at least one protrusion or protuberance for interacting with a plate passage detector of a device as described above.

Cladding refractory elements, casting plates or casting tubes by an element such as a metallic casing is known in the art. These casings are well known to those skilled in the art along with the types of materials used to produce said casings. The refractory is preferably contained or cemented into the metallic casing.

The invention also relates to a metallic casing for a casting plate of a continuous molten metal casting installation comprising at least one protrusion or protuberance for interacting with a plate passage detector of a device as described above.

The casings are generally metallic, particularly made of steel or cast iron. Obviously, any other materials capable of fulfilling the same function could be used. The same applies for the protrusion.

In one embodiment, the casing comprises:

- a main surface comprising an opening and side edges extending to said main surface and defining the perimeter thereof;
- two bearing surfaces substantially longitudinal and intended to slide along the guiding means of the device,
- projecting from the main surface, a protrusion extending in the plate sliding direction, the sliding direction being substantially parallel with the longitudinal bearing surfaces.

In one particular embodiment, the casing comprises:

- two longitudinal bearing surfaces intended to slide along the rails of the device for guiding the plate,
- longitudinal bottom edges parallel with said longitudinal bearing surfaces and,
- projecting from at least one of said longitudinal bearing surfaces, a protrusion extending in the plate sliding direction, that is parallel with the longitudinal bearing surfaces.

The bearing surfaces may have various shapes, for example be planar, inclined, or convex. It is simply necessary for them to serve as a support for the casting plate and enable the movement thereof from a standby station to an operating station.

In general, the bearing surface is parallel with the plate sliding or replacement direction. In this case, the term "parallel" should be understood in the broad sense, i.e. the bearing surface comprises at least one line segment or generating line parallel with the plate replacement direction. Similarly, an edge or a protrusion is parallel with the bearing surfaces if the edge or protrusion comprises a line segment parallel with the plate replacement direction.

In certain embodiments, the casing further comprises one or any combination of any of the following features:

- the casing comprises two pairs of opposed side edges as follows: two longitudinal edges and two transverse edges
- the two segments respectively parallel to the transverse edges and the longitudinal edges of the casing and comprising the centre of the opening divide the casing into four quadrants; two quadrants being larger
- the casing comprises a tubular portion matching and extending from the opening of the main surface
- the casing has an overall rectangular outline.
- the casing comprises longitudinal bottom edges parallel with said longitudinal bearing surfaces and, projecting from at least one of said longitudinal bearing surfaces, a protrusion extending in the plate sliding direction, the sliding direction being parallel with the longitudinal bearing surfaces
- the bearing surfaces are planar
- the bearing surfaces are not comprised in the same plane
- the casing comprises a pair of opposed side edges, one of which has a first thickness and the second of which has a second thickness greater than said first thickness the casing is made of cast iron The protrusion of the casing may be situated on only one side of the metallic casing.

In certain embodiments the casing comprises two protrusions wherein each protrusion is situated on either side of the metallic casing, symmetrically in relation to the longitudinal axis of said casing. This configuration is particularly interesting. As explained above, the means for selecting the stroke is located on the pusher. Depending on the casting installation and the space available in the vicinity of the metallurgical vessel, the pusher can be connected on the left side or the right side of the device. In case the vessel comprises a plurality of casting lines each equipped with a device, some may have the pusher on the left side and some others on the right side. Having two protrusions located symmetrically on each side of the plate permit the use of the plate equivalently on all the casting lines, this way, ensuring in all cases the interaction with the passage detector and the correct selection of the stroke.

In certain embodiments, the metallic casing protrusion is tapered in the plate sliding direction.

Advantageously, the protrusion or each protrusion comprises one or any combination of any of the following features:

- the protrusion is formed by a ramp comprising an inclined portion, the inclination being in the plate sliding direction
- the protrusion comprises a portion parallel with the bearing surfaces or the bottom longitudinal edges
- the protrusion is located outside of the bearing surface
- the protrusion is located adjacent the bearing surface
- the protrusion is located on the longitudinal sides of a rectangle or outside of a rectangle, the rectangle being formed by the transverse side edges of the casing and the two tangents to the tubular opening parallel to the longitudinal side edges of the casing
- the protrusion is located in the two larger quadrants In view of the high mechanical stress generated on the casing during use as well as the risk of damage of the protrusion(s) or ramp(s) during transport or handling, the casing is in certain embodiments relatively thick and obtained by moulding, e.g. by casting into a mould.

The invention also relates to a casting plate for a continuous molten metal casting installation, of the type comprising a sliding face wherein a casting channel opens and wherein a sealing surface capable for sealing a metallurgical vessel casting channel is formed, consisting of:

- a refractory defining the casting channel and forming the sliding face,
- a metallic casing encasing the refractory in the vicinity of the sliding face, characterised in that the metallic casing comprises a protrusion for interacting with a plate passage detector of a device as described above. In certain embodiments, the casting plate comprises a metallic casing as described above.

Advantageously, the casting plate comprises one or any combination of any of the following features:

- the protrusion of the casting plate projects in the direction opposite the casting plate sliding surface.
- the protrusion or each protrusion (30) of the casting plate is formed by a ramp comprised in a plane orthogonal to the sliding face and comprising an inclined portion (30*a*) and optionally a portion (30*b*) substantially parallel with the sliding face (19*a*, 20*a*).
- the plate comprises a refractory tubular extension opposite the sliding face, to extend from the casting channel. The tubular extension may be sufficient to immerse the lower portion thereof in the molten metal mould.

The invention also relates to a method for producing a plate according to the invention comprising the step of assembling a metallic casing and a refractory element. Assembly is performed using known means. In certain embodiments, the refractory is cemented into the metallic casing or assembled by casting a refractory concrete between the refractory element and the casing (cast around). It can also be considered to recover the metallic casing after use and assemble it with a new refractory element.

BRIEF DESCRIPTION OF THE SEVERAL VIEWS OF THE DRAWINGS

To explain the invention more clearly, an embodiment given as a non-limitative example of the scope of the invention will now be described, with reference to the appended figures wherein.

DETAILED DESCRIPTION OF THE INVENTION

The embodiment described herein is applicable to a casting installation distributor (or tundish) but could apply to any metallurgical vessel and particularly a casting ladle, as well as a distributor.

The distributor, also called tundish, is used to distribute molten metal to one or a plurality of casting moulds, supplied by casting ladles successively pouring their content thereof into the distributor. For this purpose, the distributor may comprise a plurality of casting orifices, only one of which is taken into consideration in this case.

The example illustrated by the figures relates to a casting plate comprising a tubular refractory extension, also referred to by those skilled in the art as "outer nozzles" or "casting tubes" but it could also apply to calibrated plates or nozzles not comprising tubular extensions or merely a slight tubular extension. In the context of the present invention, casting plates can be used to transfer the molten metal in the form either of a free flow with a short tube, or of a guided flow with a longer, partly submerged casting tube.

Figure 1:
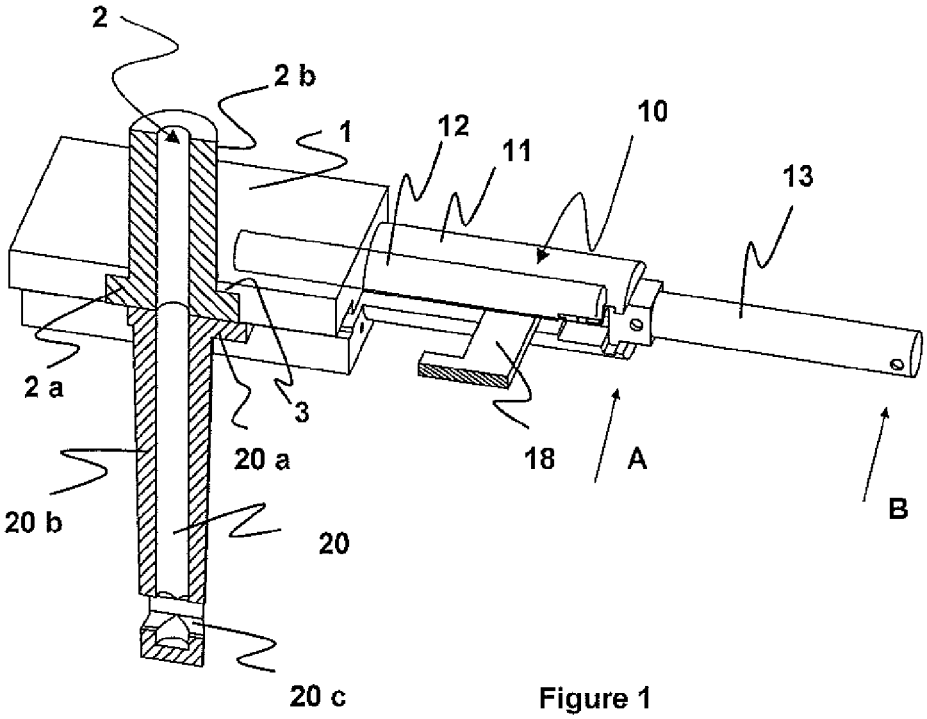
FIGS. 1, 2, and 24 are sectional perspective views of a casting tube changer device for a tundish of a casting installation according to the invention.

FIG. 1, the device comprises a frame 1 comprising means for attachment to a metallurgical vessel such as a tundish (not shown), in the vicinity of an orifice of said vessel. An inner nozzle 2 is positioned in the frame. The inner nozzle comprises a lower portion in the form of a plate 2*a* and an upper tubular extension 2*b*, passing through the wall of the vessel (not shown). In the present description, the casting channel of the inner nozzle 2 is considered to be the casting orifice of the metallurgical vessel.

The frame 1 comprises a housing 3 for receiving the plate 2*a* of the inner nozzle 2.

The plate 2*a*, hereinafter referred to as the "top plate", as opposed to that of the outer nozzle, described below, is held firmly in the housing 3 of the frame by known clamping means not described herein. The top plate is a fixed element during metal casting.

The frame 1 bears a pusher 10 having a general cylindrical shape extending along a substantially horizontal axis (in the machine operating position), substantially orthogonal to the casting channel of the inner nozzle 2. This pusher 10 comprises a hollow cylindrical body 11 attached to the frame and a rod 12 suitable for sliding axially in the cylindrical body 11 under the action of a hydraulic jack 13 borne by one of the end of the body 11.

The single-stroke hydraulic jack 13 controls the rod 12 in the axial translation movements thereof.

Hydraulic connections (ducts or pipes, represented by the arrows A and B) supply the hydraulic jack 13 with pressurised fluid.

The cylindrical body 11 comprises a longitudinal slot through which an arm 18, rigidly connected to the rod 12, projects from the cylindrical body 11, in the direction of the frame 1.

The slot is rectilinear apart from at the end close to the jack, where it forms a gap, known per se, which gives the arm 18 an idle (resting) position wherein it is released upwards in relation to the working positions thereof.

The length of the slot is substantially identical to the maximum stroke of the hydraulic jack 13, enabling the movement of the rod 12 and the arm 18 on the entire stroke.

Figure 3:
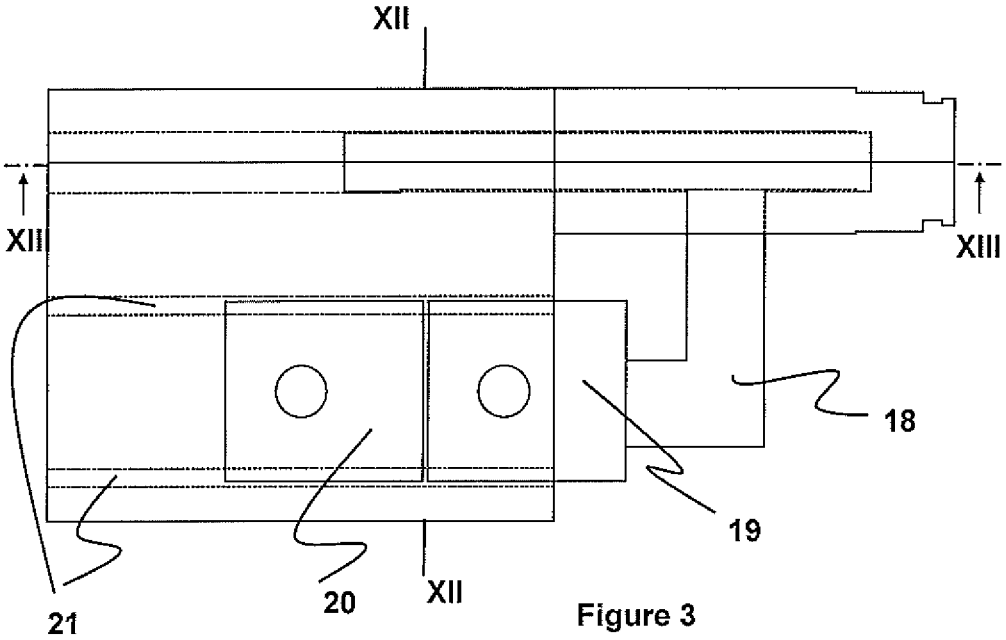
FIG. 3 is a top view of the frame of the device.

In FIG. 3, it can be seen that the arm 18 is arranged to push a casting tube 19, also referred to as an "outer nozzle" waiting in standby position next to another casting tube 20 which is in casting position. The pusher 10 is thus suitable for pushing a casting plate or tube from a standby station to an operating station.

Figure 4:
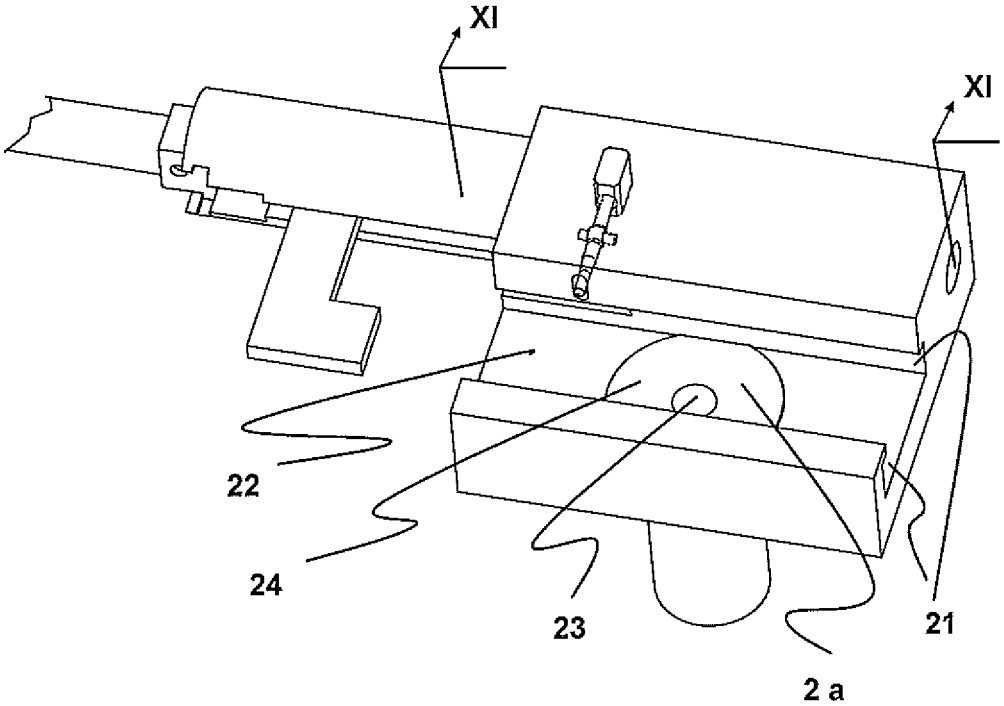
FIG. 4 is a perspective bottom view of the device.

In FIG. 4, it is first of all noted that the plate 2*a* of the inner nozzle (the "top plate"), wedged in the housing 3 of the frame, is slightly raised in relation to the plane bottom face 22 of the frame.

It is also noted that the top plate 2*a* has, about the casting orifice 23 thereof, a plane surface 24 (wherein a known gas injection groove (not shown) may be formed).

Rails 21 are positioned facing the plane bottom face of the frame. The tubes 19, 20 are moved along the rails 21.

On the trajectory of each rail 21, pressing means, usually springs combined with cams (not shown in the figures and known to those skilled in the art), are arranged to apply a thrust on the face of the plate of a tube 19, 20 inserted on the rails in the direction of the top plate 2*a*.

Returning to FIG. 2, it can be seen that each casting tube 19, 20, comprises a plate 19*a*, 20*a* and a tubular section 19*b*, 20*b* extending from the casting channel to lateral outlets 19*c*, 20*c* through which the molten metal flows into an ingot mould (not shown).

Each plate 19*a*, 20*a* comprises a sliding face 19*d*, 20*d* wherein the casting channel opens. Downstream from said channel (in relation to the tube sliding direction), the sliding face 19*d*, 20*d* is sufficiently large to form a sealing surface or shut-off surface 19*e*, 20*e* suitable for sealing (closing) the vessel casting orifice.

Figure 2:
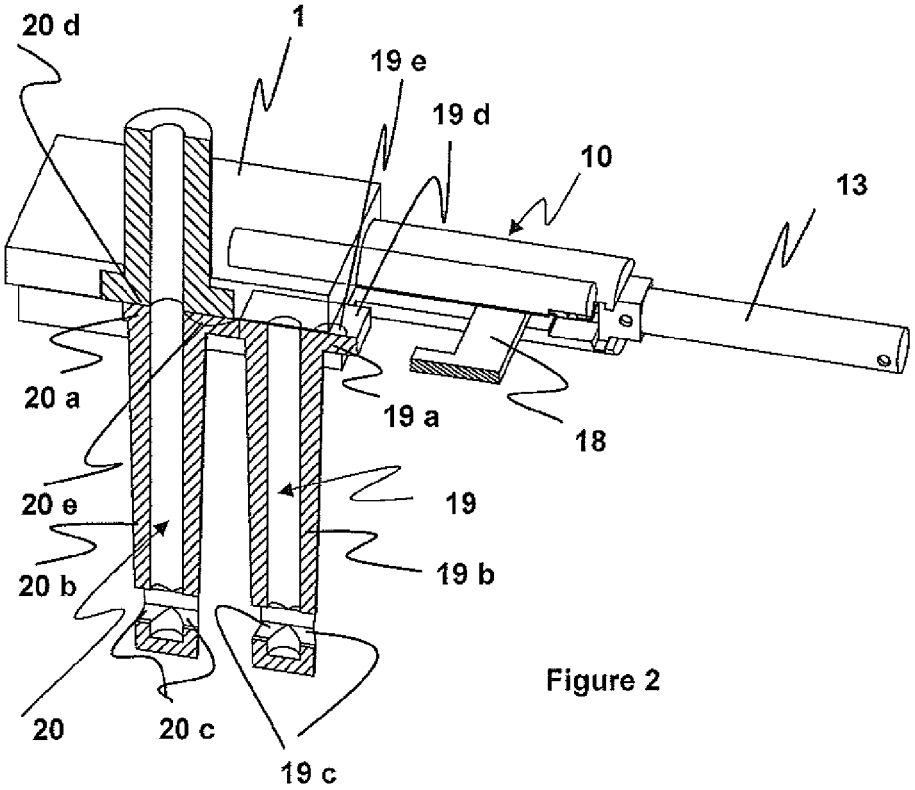
Figure 24:
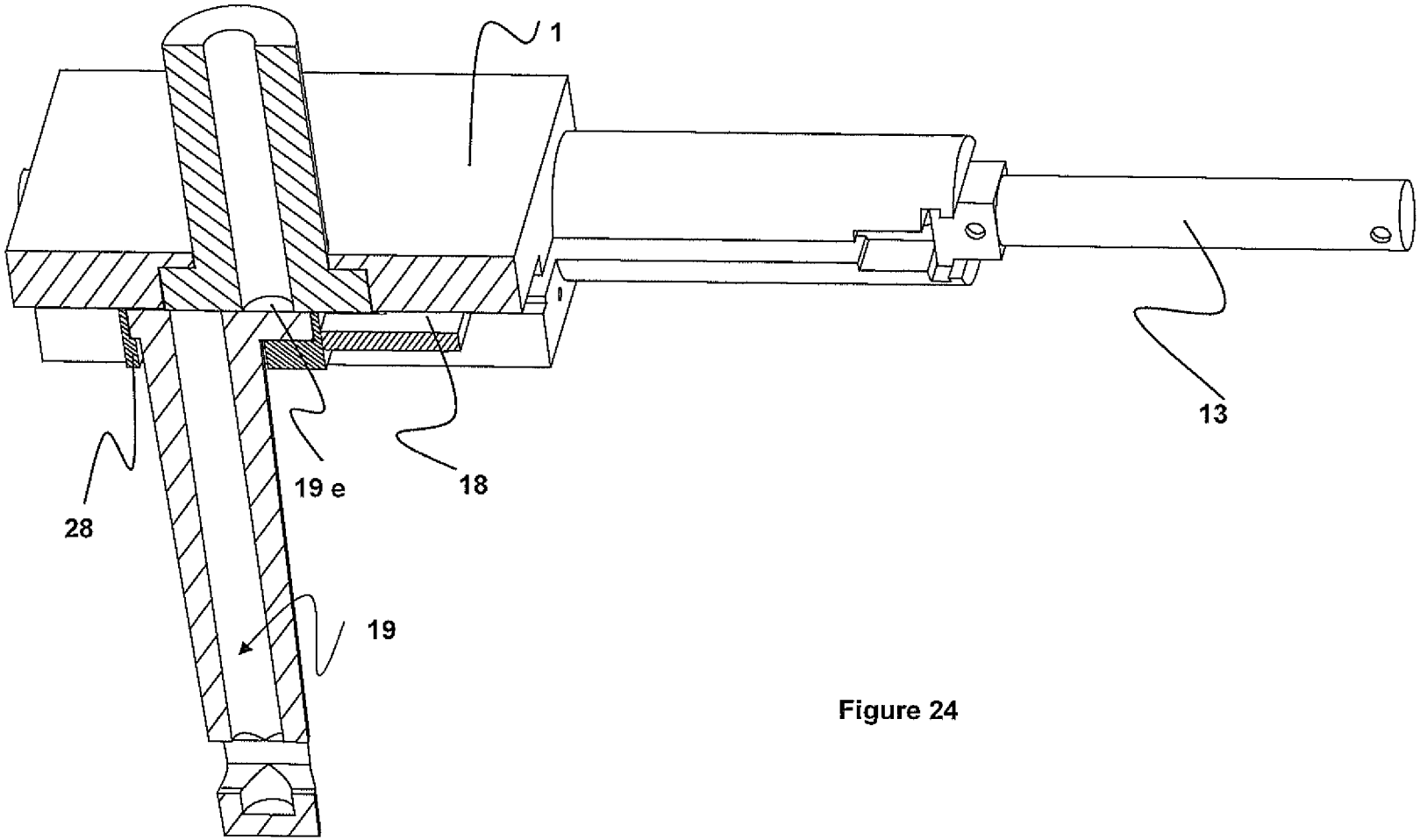

A tube on the operating station may thus adopt a casting position, like the tube 20 in FIGS. 1 and 2, wherein the casting channel thereof is facing the vessel casting orifice, and a sealing position, like the tube 19 in FIG. 24, wherein the sealing surface 19*e* thereof is facing the vessel casting orifice.

Each casting tube has a metallic casing 28 (also referred to as can by those skilled in the art) cladding the plate thereof, in a known manner.

Figure 5:
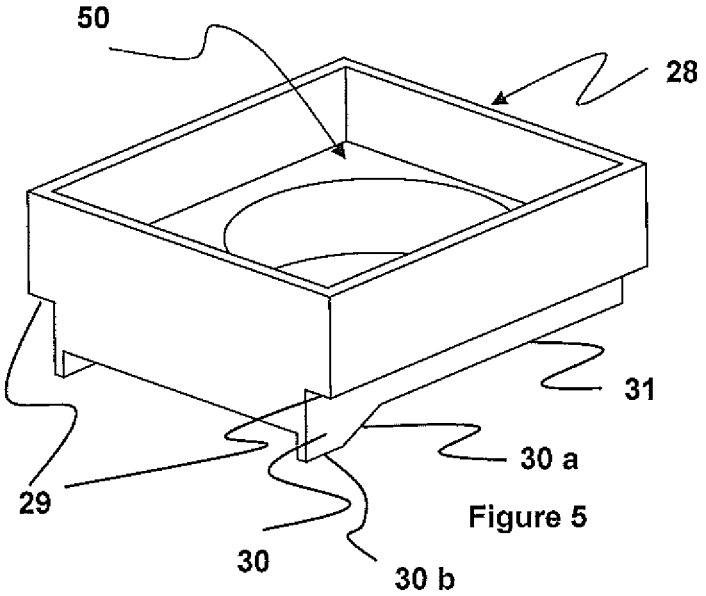
FIGS. 5 and 5*a* are perspective views of a metallic casing of a casting plate according to the invention.
Figure 6:
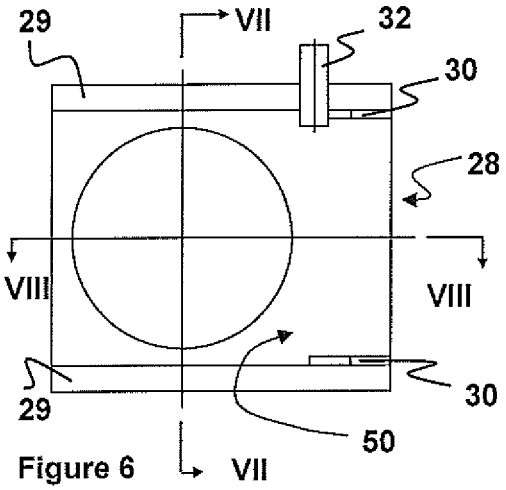
FIGS. 6, 6*a* and 6*b* are bottom views of the metallic casing of FIG. 5.
Figure 7:
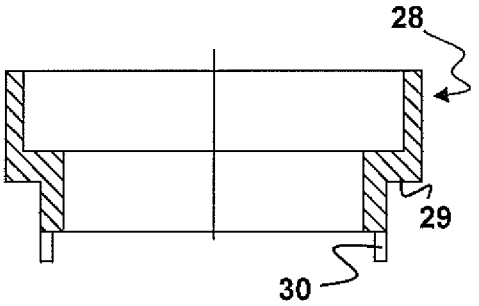
FIG. 7 is a sectional view of the casing of FIG. 6 along VII-VII.
Figure 5A:
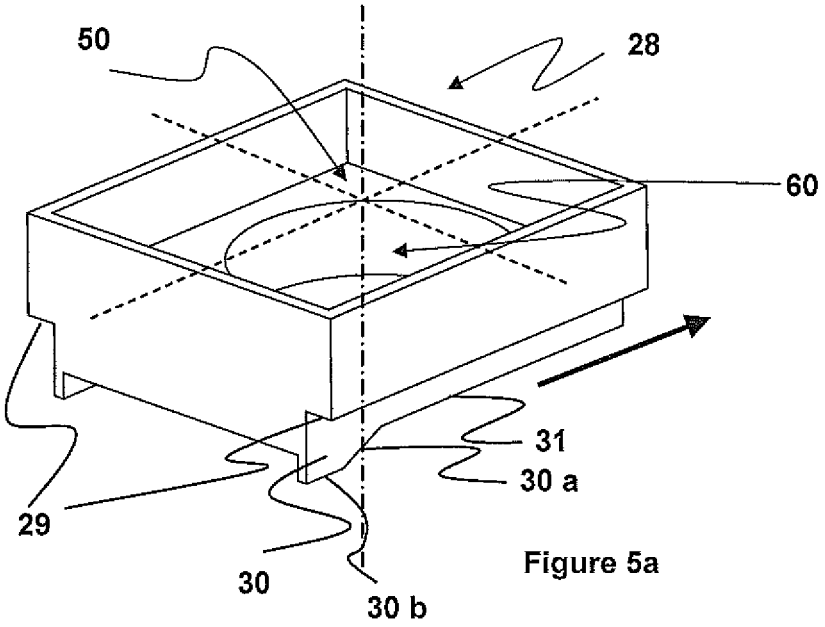

FIGS. 5 and 5*a* represent such a metallic casing 28 according to one embodiment of the invention. The metallic casing 28 is represented upright, i.e. in the orientation of the tubes 19, 20 represented in FIGS. 1, 2 and 24. The plate sliding direction is represented by the arrow.

Generally speaking, the metallic casing 28 is similar to the metallic cans according to the prior art. In particular, it has an overall rectangular outline and comprises

- a main surface 50 comprising an opening and side edges extending to the main surface and defining the perimeter thereof and
- two longitudinal bearing surfaces 29 for sliding on the rails 21 of the device for guiding and for, in operation position, pressing up the bottom plate 19*a*, 20*a* against the top plate 2*a*.

However, the metallic casing 28 of the present invention further comprises a protrusion 30 extending in the plate sliding direction, e.g. parallel with the longitudinal bearing surfaces 29, In the particular embodiment of FIGS. 5 and 5*a*, the casing comprises two protrusions, each protrusion 30 of the casing 28 projecting from longitudinal bottom edges 31, the edges 31 being parallel to the bearing surfaces 29. The bearing surfaces 29 and the edges 31 extend in the plate sliding direction represented by the arrow. The edges 31 are optional as the protrusion could project from the main surface 50.

Each protrusion 30 is formed by a ramp comprising an inclined portion 30*a* and a portion 30*b* parallel with the bearing surface 29 or the longitudinal edges 31.

Figure 8:
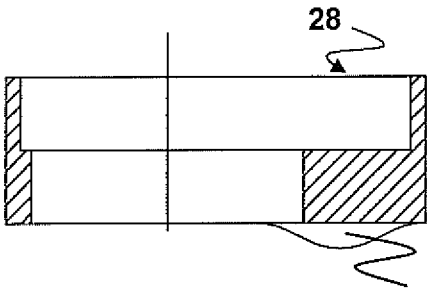
FIGS. 8 and 9 are sectional views along VIII-VIII (plane positioned in FIG. 6) of two alternative embodiments of metallic casings.
Figure 9:
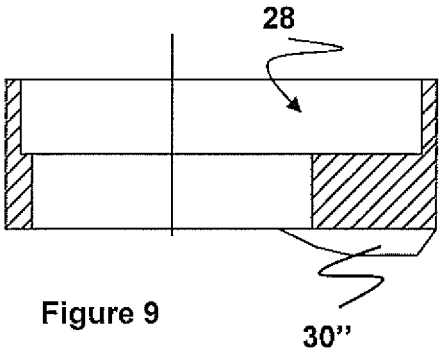

In the alternative embodiments illustrated in FIGS. 8 and 9, the protrusions 30' and 30" have different profiles, but providing substantially the same effects. In FIG. 8, the protrusion 30' has a profile obtained by tangent circular portion connection. In FIG. 9, the protrusion 30" comprises four ramps connected by sharp angles.

Figure 5B:
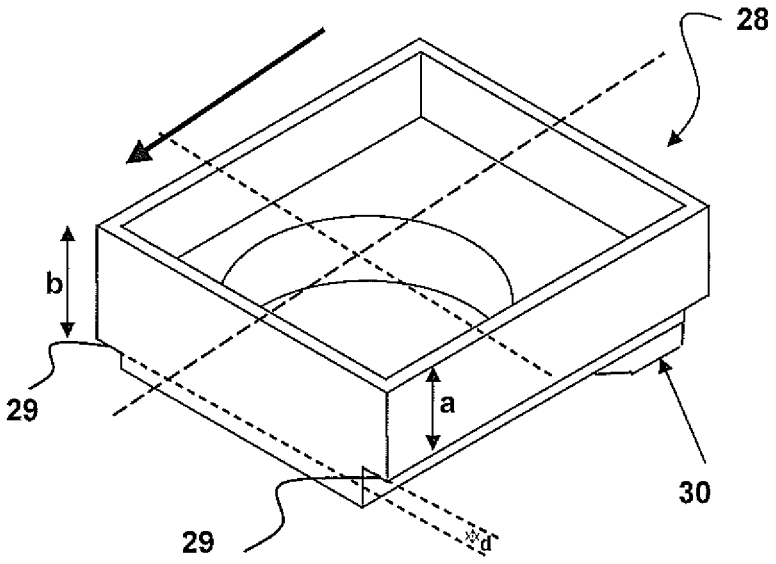
FIG. 5*b* is a perspective view of another embodiment of the casing.

FIG. 5*b* represents an alternative embodiment, the casing comprises a pair of opposed side edges, one of which has a first thickness (a) and the second of which has a second thickness (b) greater than said first thickness (a). This way, the bearing surfaces 29 are spaced apart vertically from a distance (d). This provides a foolproof or safety system as the casting plate can only be introduced into the device in the correct orientation.

Regardless of the profile thereof, each protrusion 30, 30', 30" is arranged to engage with a plate passage detector between the standby station and the operating station. In the example described, said detector takes the form of a pivoting lever 32 hinged on the machine frame 1, particularly seen in FIGS. 10, 12, 14, 15, 17, 19 and 22.

So as to properly interact with the lever of the device, the protrusion has to be positioned in a specific area of the main surface, the area depending on the position of the lever 32 in the device.

Figure 6A:
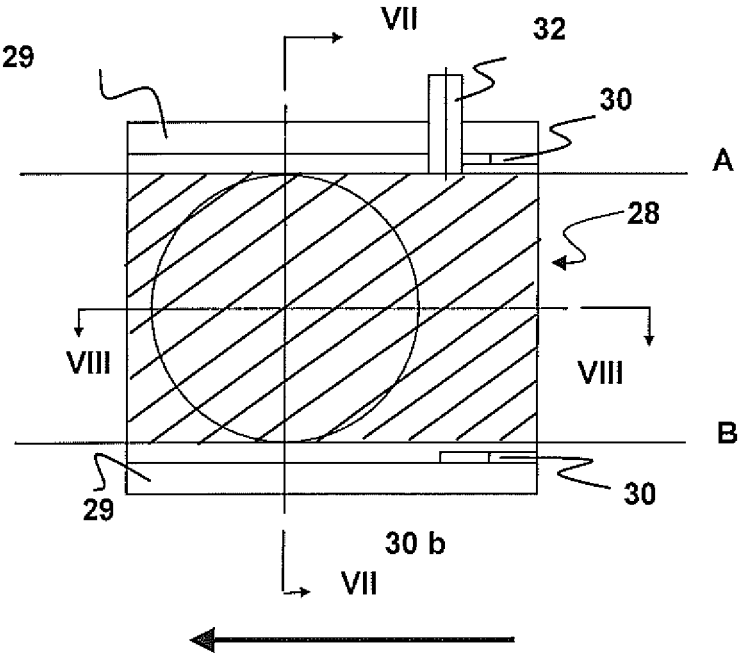
Figure 6B:
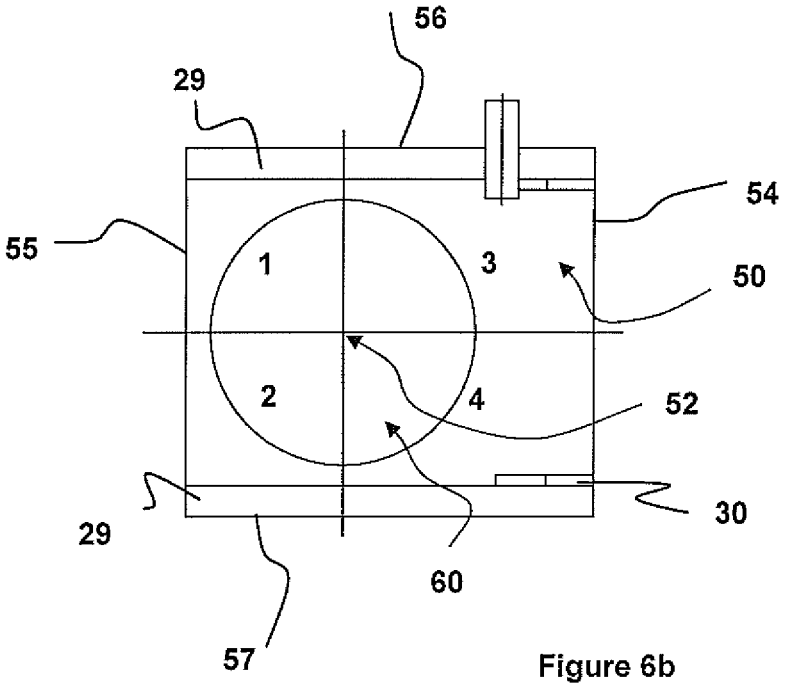
Figure 10:
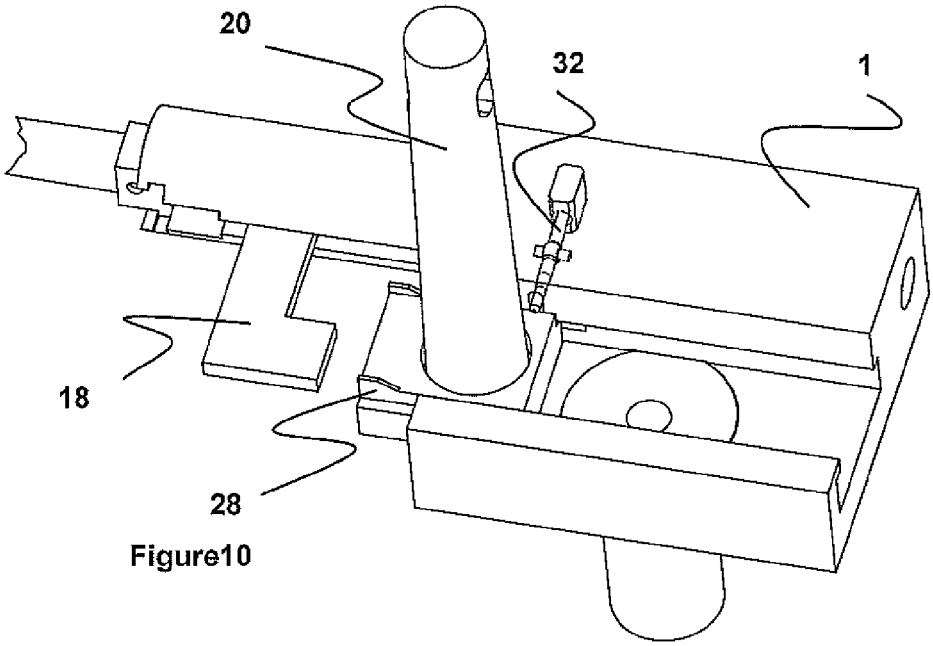
FIGS. 10, 15, 17, 19 and 22 are perspective bottom views of the device at various phases along the plate displacement.
Figure 11:
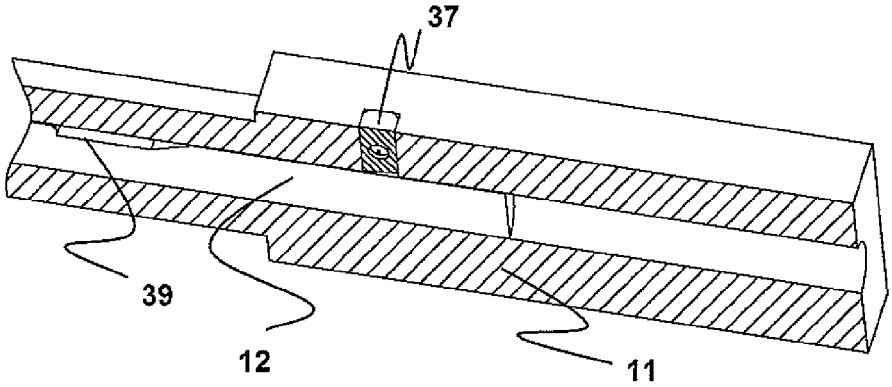
FIGS. 11, 16, 18, 20, 21 and 23 are sectional views along XI-XI (plane position in FIG. 4) of the pusher rod and limit switch.
Figure 13:
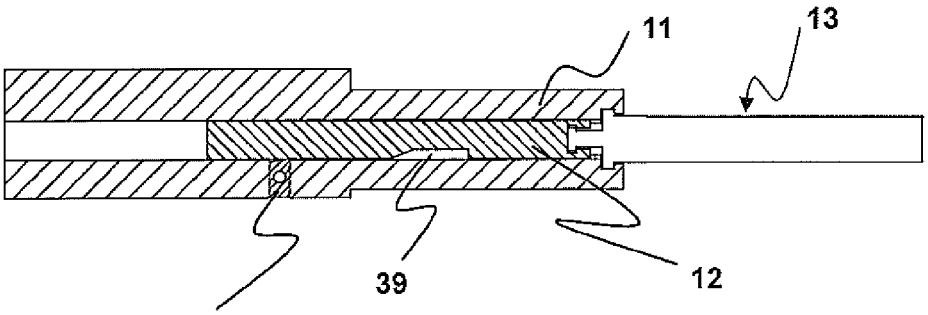
FIGS. 12, 13, are sectional views of the machine along the planes XII-XII, or XIII-XIII in FIG. 3.

As illustrated in FIG. 6*b*, the casing 28 comprises two pairs of opposed side edges as follows: two longitudinal edges 56,57 and two transverse edges 54,55, the two segments respectively parallel to the transverse edges and the longitudinal edges of the casing 28 and comprising the centre 52 of the opening divide the casing into four quadrants (1, 2, 3, 4); two quadrants being larger (3, 4). The protrusion is located in the two larger quadrants (3, 4) for proper interaction with the lever 32.

Similarly, the protrusion should be located outside of the bearing surfaces 29 to avoid a possible interaction of the protrusion with the rails and/or the pressing means of the device.

As illustrated in FIG. 6*a*, a rectangle is formed by the transverse side edges 54, 55 of the casing and the two tangents (A, B) to the tubular opening which are parallel to the longitudinal side edges 56,57. In certain embodiments, the protrusion is located on the longitudinal sides of the rectangle (A, B) or outside of the rectangle. The opening of the casing 28 is intended to receive the refractory tubular extension (19*b*,20*b*) of the casting plate 19,20. It is thus preferable that the passage for displacing the casting tube remains free to avoid a possible interaction of the lever with the refractory tubular extension (19*b*,20*b*). In FIG. 6*a*, the protrusion is located between the bearing surfaces 29 and the tangents (A, B). However the protrusion could be located on the tangents A or B as long as there is no interaction of the plate passage detector 32 with the refractory tubular extension 19*b*, 20*b*.

Figure 12:
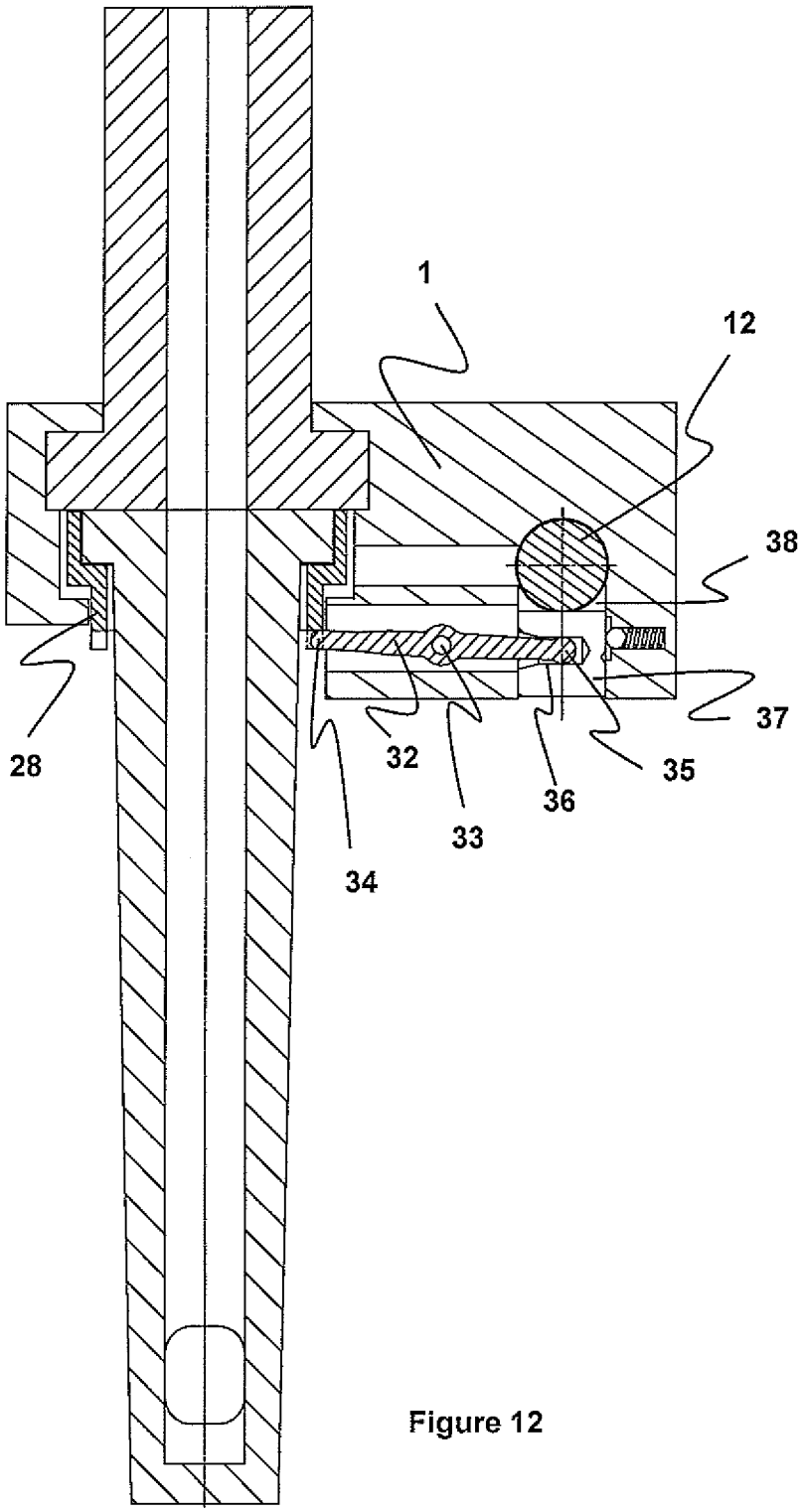

As can be seen in the sectional view in FIG. 12, the pivoting axis 33 of the lever 32 is parallel with the axis of the jack 13 and the rod 12. When pivoting, the lever may adopt a first so-called unlocked position, illustrated by FIG. 12, and a second so-called locked position, illustrated by FIG. 14.

In more detail, the lever 32 comprises one detection end 34 leaving the passage free for the edge 31 of the casing 28 when the bottom plate slides on the rails 21, regardless of the position of the lever. On the other hand, when the bottom plate slides on the rails 21 between the standby station and the operating station, the lever detection end situated in the unlocked position meets the protrusion 30 of the metallic casing. In this way, by means of the inclined portion 30*a* thereof, the protrusion 30 causes the lever to change from the unlocked position in FIG. 12 to the locked position in FIG. 14.

The lever 32 comprises, opposite the detection end 34 thereof, a ball joint 35 inserted into a slot 36 of an abutment 37 movable by translation in a flue 38 perpendicular to the axis of the rod 12 and the jack 13 and opening into the cylindrical body 11.

In the unlocked position of the lever, as in FIG. 12, the movable abutment 37 is in the vicinity of the rod 12, but does not intercept the cross-section thereof. In this "sealing" (shut-off) position, the movable abutment 37 does not block (impede) the axial translation movements of the rod. The rod 12 can thus move along the entire stroke of the jack 13, referred to as the "long stroke", necessary to move a tube to the sealing position on the operating station.

Figure 14:
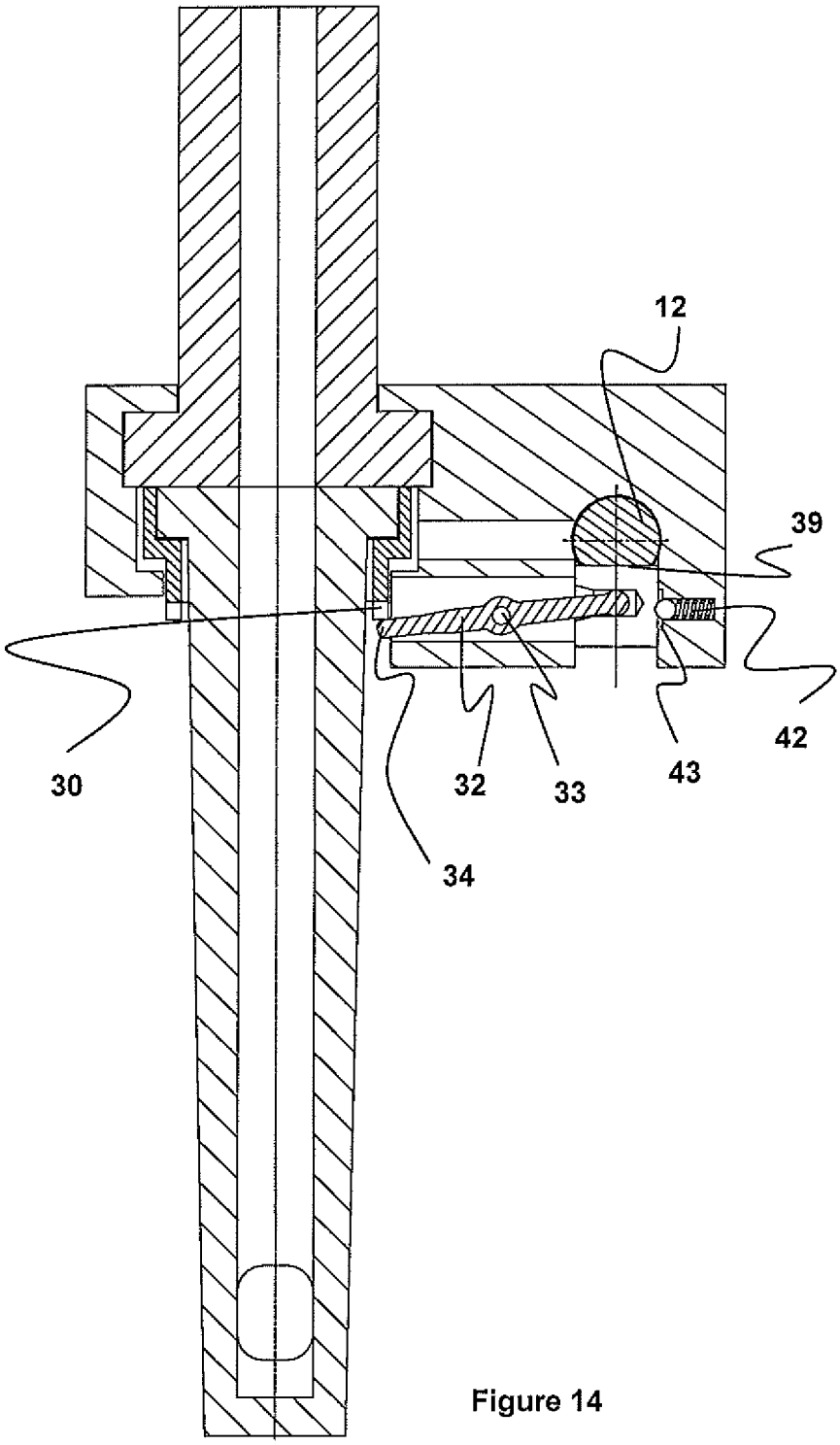
FIG. 14 is a similar view of FIG. 12, illustrating the detection of the plate during its displacement.
Figure 15:
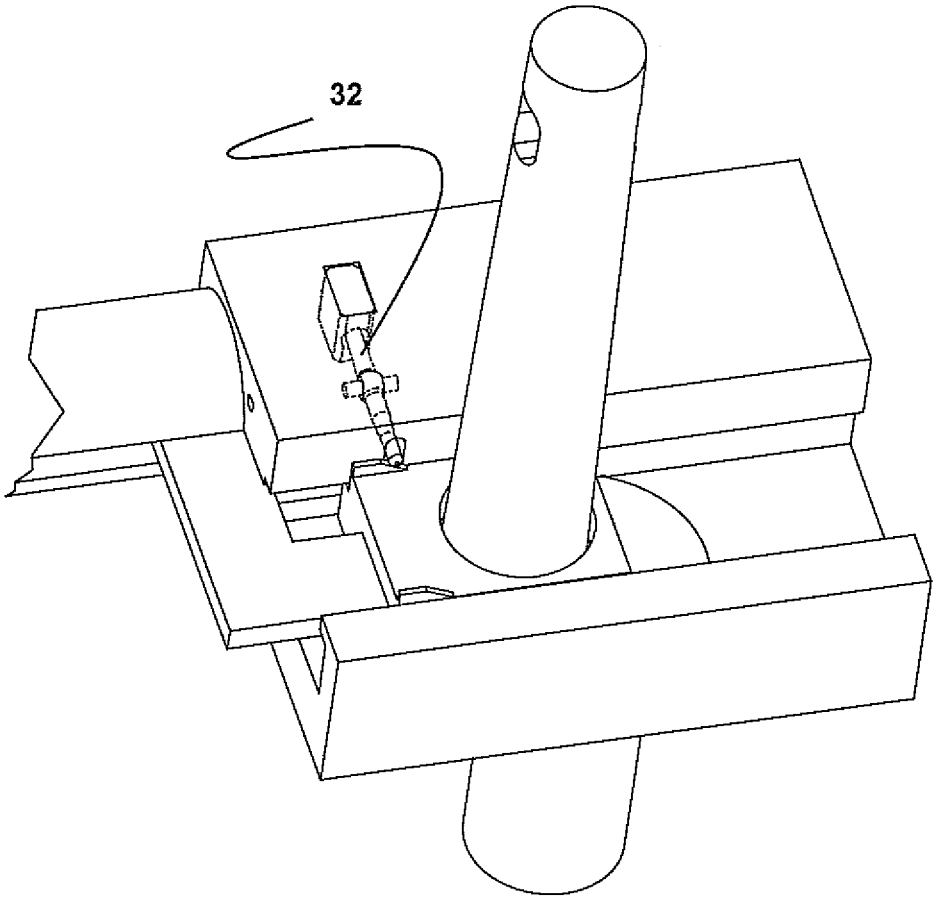

In the locked position of the lever, illustrated in FIG. 14, the movable abutment enters a recess 39 provided for this purpose on the rod 12 and holds said rod in a range of positions wherein the recess 39 is facing the movable abutment 37. In this "replacement" or "casting" position, the movable abutment 37 limits the stroke of the rod 12.

Figure 16:
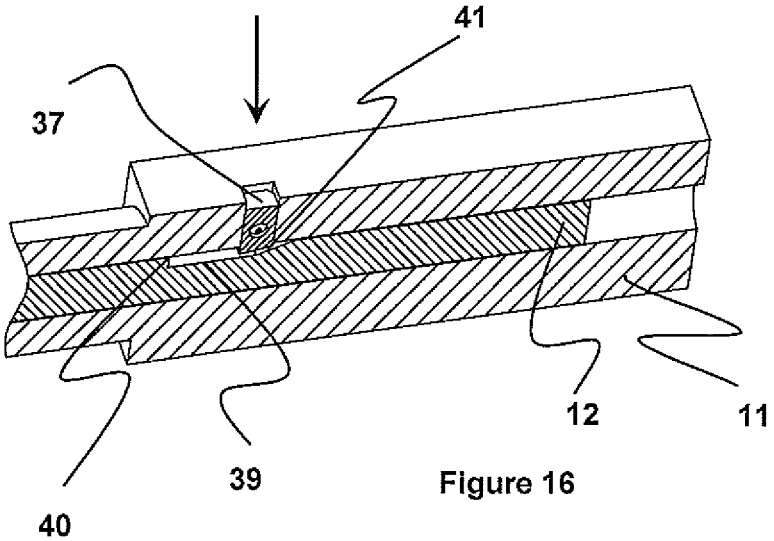
Figure 17:
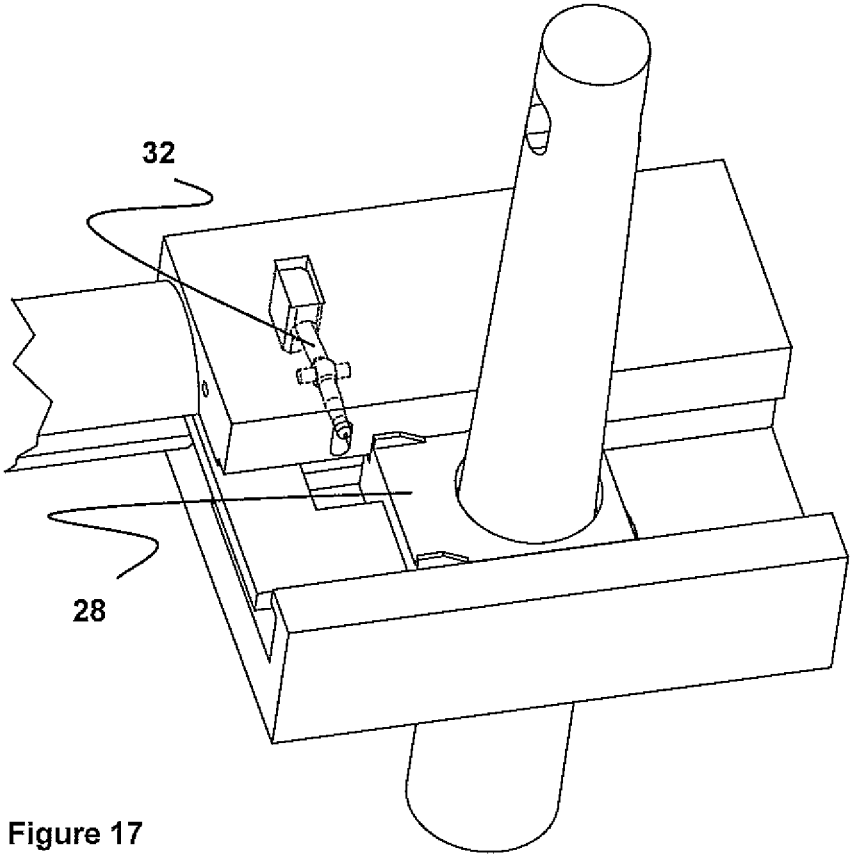

As seen in FIG. 16, the recess 39 is defined asymmetrically: on the side of the jack 13, a plane shoulder 40 perpendicular to the rod axis forms a bearing surface, whereas, opposite the jack 13, a bevel 41 is present.

This asymmetry offers the following effects.

If the movable abutment 37 is in the "replacement" or "casting" position (FIGS. 14 and 16), the movement of the rod 12 in the opposite direction of the jack 13 causes the shoulder 40 to press against the movable abutment 37, blocking the progression of the rod 12 without tending to return the movable abutment 37 to the sealing position, i.e. without tending to return the lever to the unlocked position, given that the force applied by the rod on the movable abutment 37 has no radial component. Although it is theoretically not necessary to hold the lever in the locked position to ensure the blocking of the rod, otherwise to prevent it from collapsing under its own weight, a ball spring 42 acts as a stabiliser, holding the movable abutment, and thus the lever, in each of the two positions thereof (replacement or casting position and sealing position), by entering hollows 43 formed in the face of the movable abutment 37 facing the ball spring 42.

In this replacement position, the movable abutment 37 limits the stroke of the rod to a "short stroke", necessary to move a casting tube to the casting position on the operating station.

Figure 20:
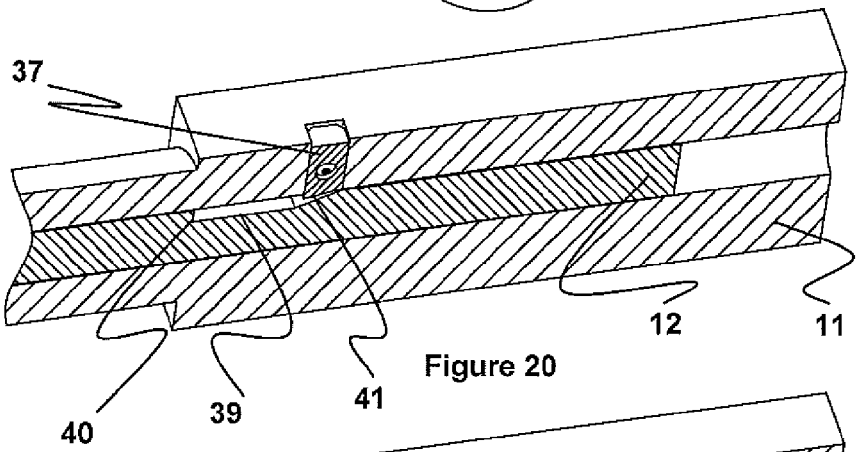

During a movement of the rod 12 in the opposite direction, i.e. in the direction of the jack 13, the movable abutment 37 comes into contact with the bevel 41 and the force applied by the rod on the movable abutment 37 comprises a radial component tending to move the lever to the unlocked position. As soon as this force is greater than the resistance opposed by the ball spring 42, the movable abutment 37 and the lever 32 move to the unlocked position, freeing the passage for the rod, as illustrated in FIG. 20.

To summarize, the pusher 10 is provided with means for moving selectively forwards along two strokes, said means consisting of the pivoting lever 32 and the movable abutment 37, combined with the rod 12 provided with the recess 39 thereof. The two pusher strokes are:

- a short stroke (FIG. 18) pushing a casting tube to the casting position on the operating station, and
- a long stroke (FIG. 23) pushing a casting tube to the sealing position on the operating station.

The movable abutment 37 and the corresponding recess 39 on the rod 12 thus form a limit switch according to the invention and the pivoting lever 32 forms a tube passage detector from the standby station to the operating station.

The operation of the device during a tube replacement operation and an emergency casting stop operation will now be described.

The device described above contains means forming a device for holding and replacing a casting tube 20 facing a casting orifice of a distributor of a continuous molten metal casting installation.

During continuous molten metal casting, the casting tube 20 and the inner nozzle 2 are positioned in mutual alignment, as represented in FIGS. 1 and 2.

The pivoting lever 32 is in the unlocked position and the movable abutment 37 in the sealing position.

The arm 18 is initially situated in the idle position thereof, inside a gap of the slot, as represented in FIG. 1.

When the time to replace the casting tube 20 approaches, a replacement casting tube 19 is positioned on the standby station, at the entry of the rails 21, in the vicinity of the casting tube 19 currently in use, as represented in FIG. 3.

To replace the tube 20, the jack 13 is actuated to move the rod 12 forwards.

The arm 18 then leaves the gap and is aligned with the plates 19*a* and 20*a*, and moves forwards in the direction thereof.

The arm 18 then comes into contact with the plate 19*a* and the casting tube 19 starts moving in translation on the rails 21.

Figure 18:
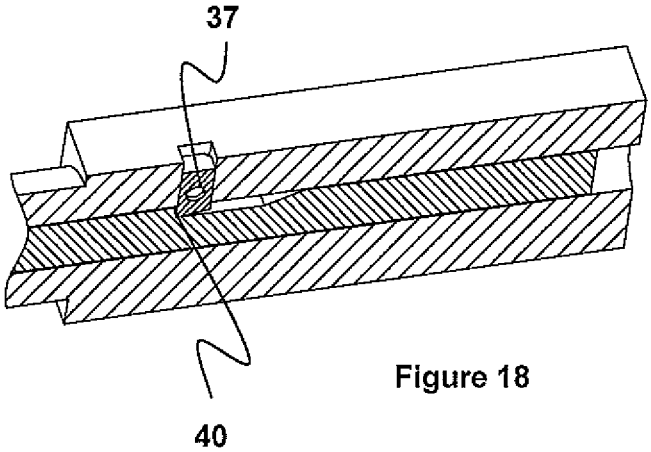

When the casting tube 19 is about to reach the operating position thereof, the protrusion 30 of the metallic casing pushes the pivoting lever 32 back to the locked position, moving the movable abutment 37 in the direction indicated by the arrow in FIG. 16, to move said abutment to the replacement position wherein it enters the recess 39 of the rod, said recess facing, at that time, the flue 38. The arm 18, the casting tube 19 and the rod 12 continue to move forwards under the action of the jack 13 until the shoulder 40 of the rod presses against the movable abutment 37, blocking the rod, as illustrated in FIG. 18. At that time, the casting tube 19 has reached the casting position thereof on the operating station. The pusher or drive has thus moved along the short stroke thereof without needing to control the jack specifically.

Figure 19:
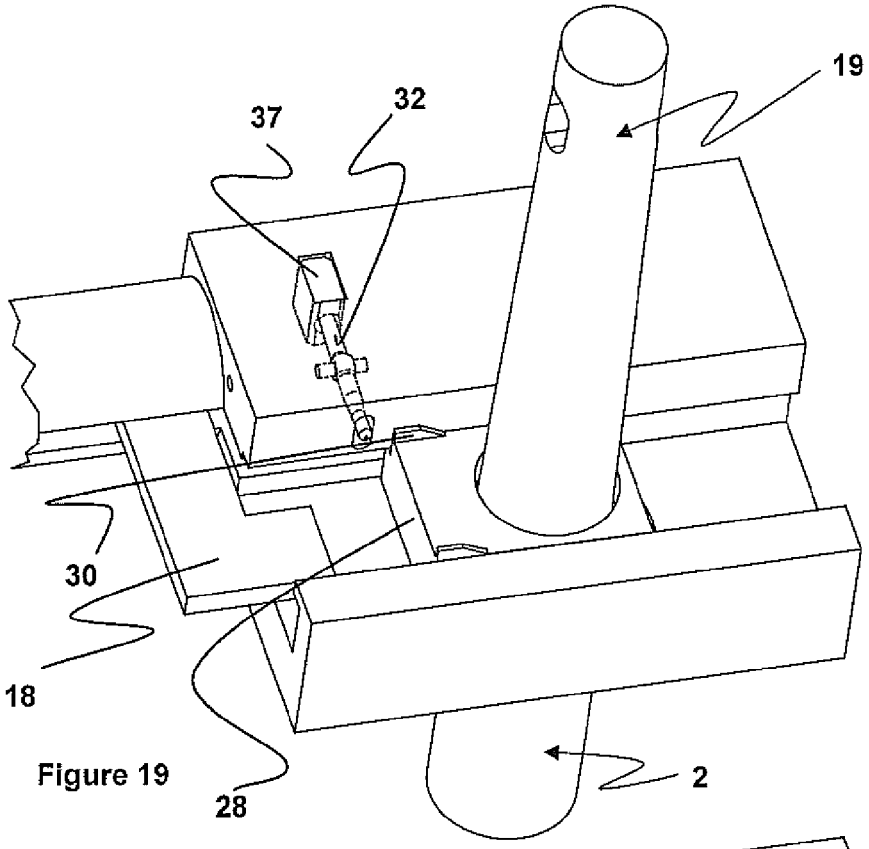
Figure 21:
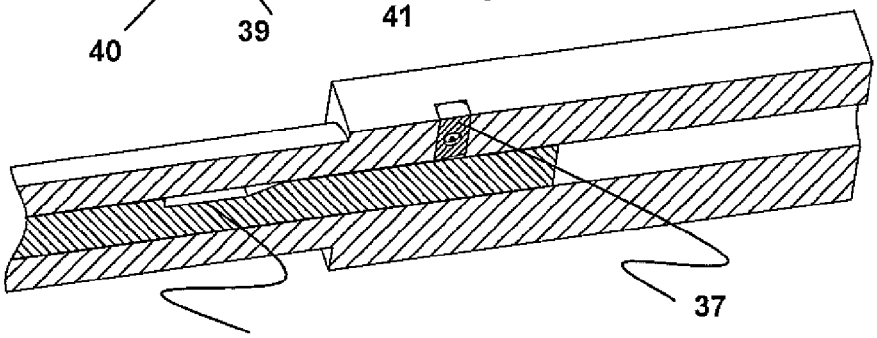

The jack 13 then returns the rod and the arm to the initial idle position thereof. The lever 32 returns to the unlocked position by means of the bevel 41 pushing the movable abutment 37 to the sealing position, as seen in FIGS. 19, 20 and 21.

With the casting tube 20 in the casting position, as illustrated in FIGS. 1 and 2, it may also be necessary in case of emergency to discontinue (interrupt) molten metal casting and it may not be possible to do so using other means inside the distributor.

In this case, the jack 13 is actuated as described above, causing the arm 18 to move forwards. Given that the movable abutment 37 is situated and remains in the sealing position, i.e. outside the straight section of the rod 12, the rod 12 can move along the entire jack stroke, as illustrated in FIG. 23. The pusher 10 thus moves along the long stroke thereof, pushing the casting tube 19 to the sealing position, as illustrated in FIGS. 22 and 24.

This way, an actuation of the jack causing the emergency interruption of the casting is obtained without needing to control the jack specifically.

Figure 22:
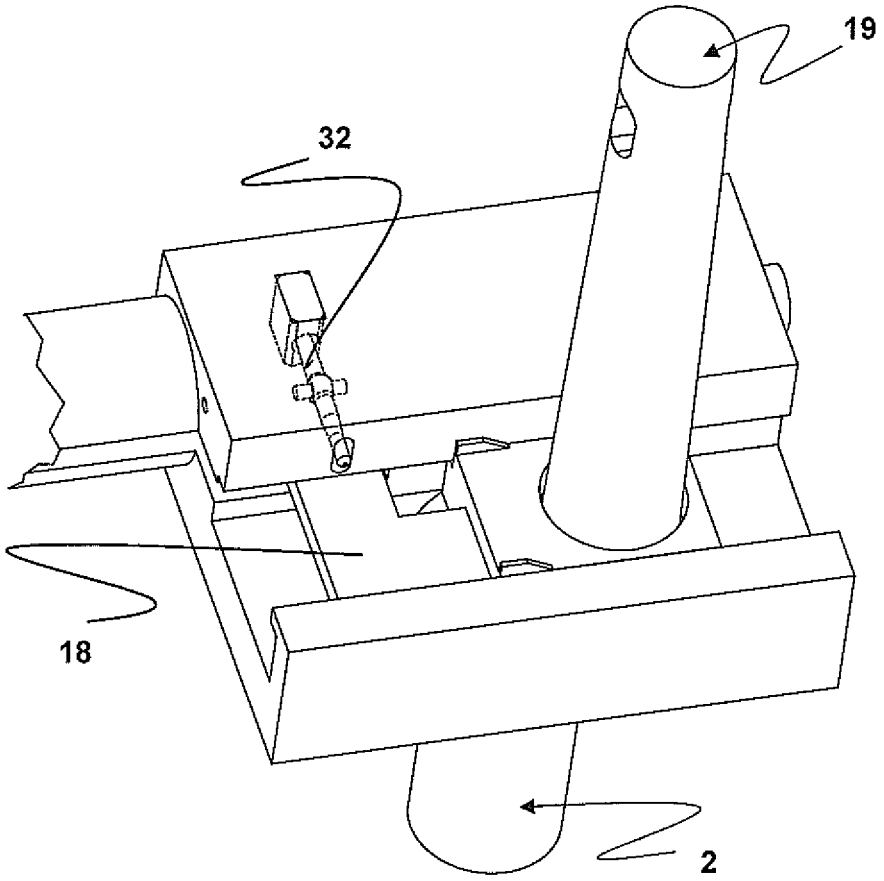
Figure 23:
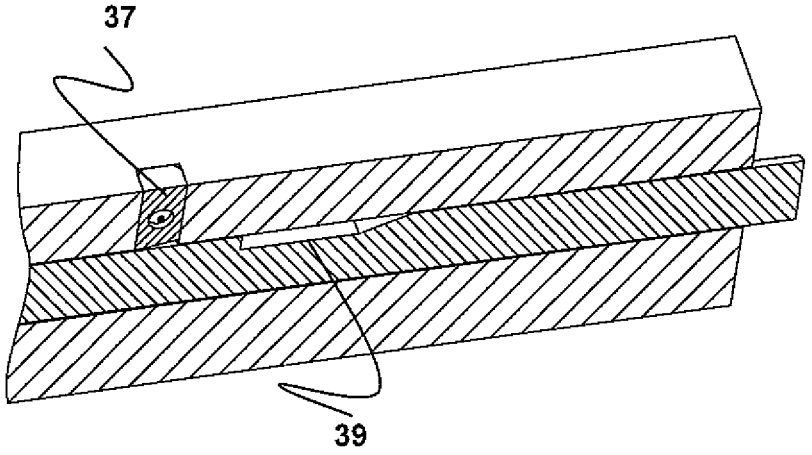

Finally, in the scenario whereby a casting tube is in reserve on the standby station when an emergency sealing of the casting orifice is required, the jack is actuated a first time to move the replacement casting tube to the casting position of the operating station, as described above, then the jack is allowed to move back along a slightly greater length than that of the recess of the rod so as to return the lever to the unlocked position, as illustrated in FIG. 20, and the jack is re-actuated again to move forwards: the rod can then move to the position in FIGS. 22 and 24 to push the casting tube to the sealing position, i.e. in the position wherein the sealing surface 19*e* thereof is facing the vessel casting orifice.

Numerous modifications and variations of the present invention are possible. It is, therefore, to be understood that within the scope of the following claims, the invention may be practiced otherwise than as specifically described.

We claim:

1. Metallic casing for encasing a refractory thus forming a casting plate, the metallic casing comprising:

a main surface having a latitudinal dimension comprising an opening and side edges extending to said main surface and defining the perimeter thereof;

two planar, substantially longitudinal bearing surfaces configured to slide along guiding rails, wherein the longitudinal dimension of the bearing surfaces comprises a plate sliding direction, and wherein each of the two bearing surfaces is disposed at a latitudinal extent of the main surface;

a detector-engaging protrusion projecting from the main surface and extending in the plate sliding direction, the sliding direction being substantially parallel with the longitudinal bearing surfaces, and being located outside of and latitudinally adjacent to one of said bearing surfaces, said protrusion being formed by a ramp comprising an inclined portion, the inclination being in the plate sliding direction, wherein the protrusion comprises a portion parallel with the bearing surfaces, and wherein the ramp comprises an inclined portion extending from the main surface to the portion parallel with the bearing surfaces; wherein the casing comprises longitudinal bottom edges parallel with said longitudinal bearing surfaces, and wherein said protrusion projects from at least one of said longitudinal bottom edge, and the bearing surfaces are planar and not comprised in the same plane as the longitudinal bottom edges.

2. The casing of claim 1, wherein the protrusion is situated on only one side of the metallic casing.

3. The casing of claim 1, comprising two protrusions wherein each protrusion is situated on either side of the metallic casing, symmetrically in relation to a longitudinal axis of said casing.

4. The casing of claim 1, wherein, the casing comprises two pairs of opposed side edges as follows: two longitudinal edges and two transverse edges, wherein two segments respectively parallel to the transverse edges and the longitudinal edges of the casing and comprising the center of the opening divide the casing into four quadrants (1, 2, 3, 4); two quadrants (3, 4) extending from the opening center in one direction parallel to the sliding direction being larger than the two quadrants (1, 2) extending in the opposite direction from the opening center, and the casing further comprises a tubular portion matching and extending from the opening of the main surface.

5. The casing of claim 1, wherein the casing further comprises a tubular portion matching and extending from the opening of the main surface, wherein the tubular portion comprises a tubular opening, and wherein the protrusion is located adjacent the bearing surface, and outside or on longitudinal sides of a rectangle formed by transverse side edges of the casing and two tangents (A, B) to the tubular opening parallel to the longitudinal side edges of the casing.

6. A casting plate, comprising:

a refractory comprising a sliding face and comprising a casting channel formed in the sliding face, and a metallic casing according to claim 1, the metallic casing encasing the refractory in the vicinity of the sliding face.

7. The casting plate of claim 6, wherein the protrusion projects away from the sliding face.

8. The casting plate of claim 6, further comprising a refractory tubular extension, to extend from the casting channel and away from the sliding face.

9. The casting plate of claim 7, wherein the protrusion is formed by a ramp comprised in a plane orthogonal to the sliding face and comprising an inclined portion.

* * * * *